US006663461B2

(12) United States Patent
Fong

(10) Patent No.: US 6,663,461 B2
(45) **Date of Patent: *Dec. 16, 2003**

(54) ANIMATED DISPLAY

(76) Inventor: Peter Sui Lun Fong, 505a 5/F Empire Centre, 68 Mody Road, East Tsimshatsui, Kowloon (HK)

( * ) Notice: Subject to any disclaimer, the term of this patent is extended or adjusted under 35 U.S.C. 154(b) by 120 days.

This patent is subject to a terminal disclaimer.

(21) Appl. No.: 10/025,140

(22) Filed: Dec. 19, 2001

(65) Prior Publication Data

US 2003/0096555 A1 May 22, 2003

Related U.S. Application Data

(63) Continuation-in-part of application No. 09/990,235, filed on Nov. 21, 2001.

(51) Int. Cl.[7] ..... A63H 1/00

(52) U.S. Cl. ..... 446/236; 446/175; 446/353; 446/242

(58) Field of Search ..... 446/175, 236, 446/242, 246, 268, 330, 352, 353; 40/428, 430, 431, 466, 470, 473

(56) References Cited

U.S. PATENT DOCUMENTS

| | | | | | |
|---|---|---|---|---|---|
| 1,711,790 | A | * | 5/1929 | Johnson | 40/473 |
| 2,157,199 | A | * | 5/1939 | Doering | 40/473 |
| 6,009,647 | A | * | 1/2000 | Feingold | 40/433 |
| 6,247,991 | B1 | * | 6/2001 | Chen | 446/242 |
| 6,422,915 | B1 | * | 7/2002 | Chen | 446/242 |

* cited by examiner

*Primary Examiner*—Jacob K. Ackun
*Assistant Examiner*—Bena B. Miller
(74) *Attorney, Agent, or Firm*—Stetina Brunda Garred & Brucker

(57) ABSTRACT

An animated display comprising an outer sleeve having an inner sleeve positioned therein. The outer sleeve is itself rotatably connected to a support base. Also included in the animated display is an actuation assembly which is cooperatively engaged to the outer and inner sleeves. The actuation assembly is operative to facilitate the rotation of the outer sleeve relative to the support base concurrently with the rotation of the inner sleeve relative to the outer sleeve.

17 Claims, 12 Drawing Sheets

ANIMATED DISPLAY

CROSS-REFERENCE TO RELATED APPLICATIONS

The present application is a continuation-in-part of U.S. application Ser. No. 09/990,235 entitled ANIMATED DISPLAY filed Nov. 21, 2001.

STATEMENT RE: FEDERALLY SPONSORED RESEARCH/DEVELOPMENT (Not Applicable)

BACKGROUND OF THE INVENTION

The present invention relates generally to motion toys, and more particularly to a uniquely configured, animated display, toy, lamp, or lantern comprising a series of rotatable cylinders and a rotatable platform which are capable of concurrent rotational movement relative to each other to provide a novel visual effect.

There is known in the prior art a wide range of animated seasonal toys which employ the use of motors and gear trains to accomplish various types of movements. Exemplary of such animated seasonal displays are talking Christmas trees, displays including an animated Santa Claus alone or in combination with Mrs. Claus, and Christmas trees with one or more openable and closeable doors which reveal an interior animated decorative scene when opened. Due to cost and pricing constraints, the majority of these animated seasonal toys do not include internal mechanics and drive systems which are capable of providing a highly sophisticated level of concurrent movement of various parts or components of the display in different directions and/or at different speeds. The present invention provides a uniquely configured animated display, toy, lamp, or lantern which provides these attributes via a novel mechanical construction of minimized complexity, and hence cost. Though the present invention finds specific utility in relation to a seasonal animated display, those of ordinary skill in the art will recognize that the mechanical construction as will be described in detail below is applicable to non-seasonal animated displays as well.

BRIEF SUMMARY OF THE INVENTION

In accordance with a first embodiment of the present invention, there is provided an animated display comprising an outer sleeve which is rotatably connected to a support base. Concentrically positioned within the outer sleeve is an inner sleeve. The inner and outer sleeves are each cooperatively engaged to an actuation assembly which is disposed within the interior of the animated display. The actuation assembly is operative to facilitate the rotation of the outer sleeve relative to the support base, and the concurrent rotation of the inner sleeve relative to the outer sleeve.

In accordance with a second embodiment of the present invention, there is provided an animated display comprising an outer sleeve which is rotatably connected to a support base. Concentrically positioned within the outer sleeve is a middle sleeve, while concentrically positioned within the middle sleeve is an inner sleeve. The animated display of the second embodiment further comprises an actuation assembly which is disposed within the interior thereof and is cooperatively engaged to each the outer, middle and inner sleeves. The actuation assembly is operative to facilitate the rotation of the outer sleeve relative to the support base concurrently with the rotation of the middle and inner sleeves relative to the outer sleeve.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
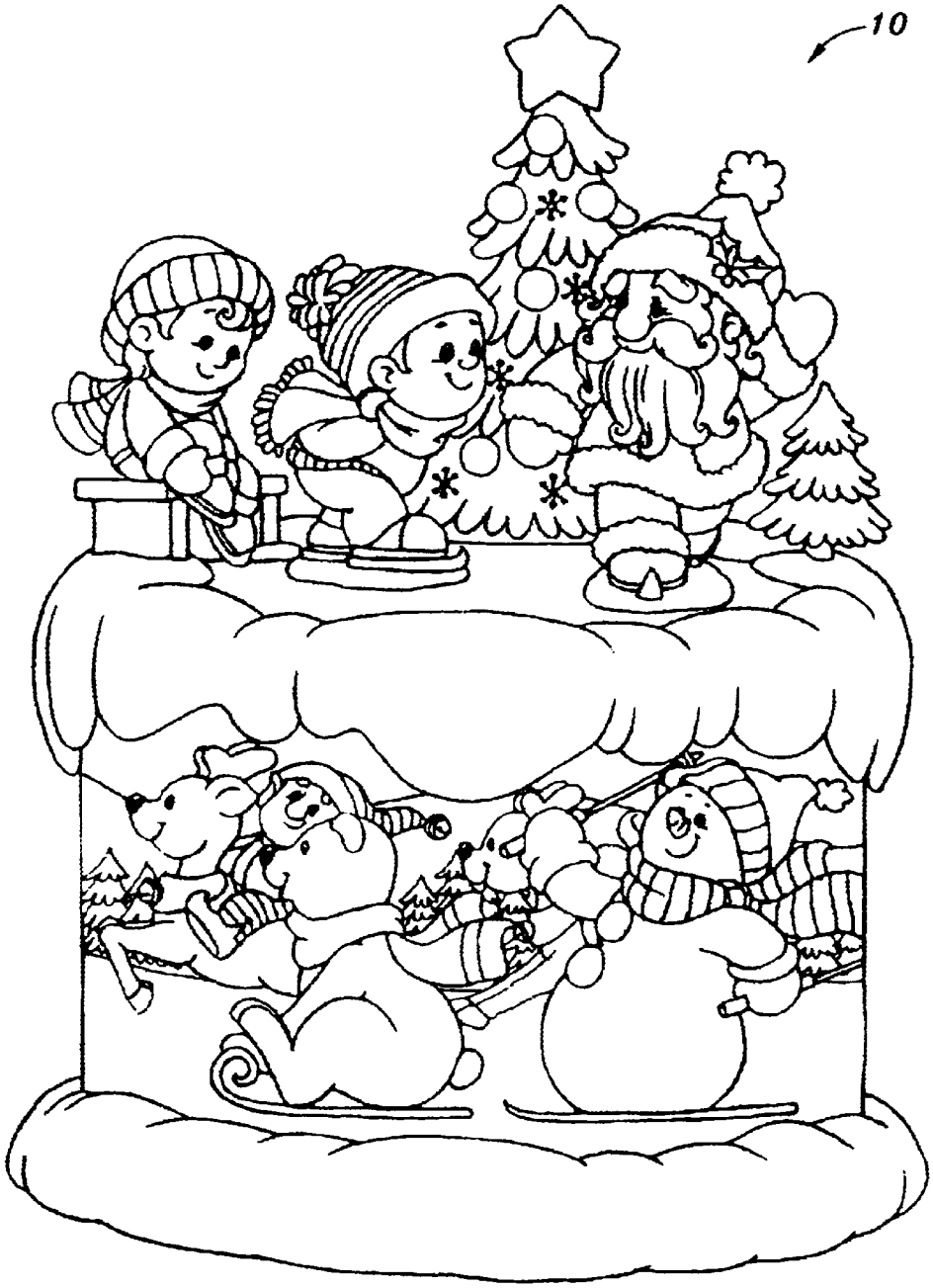
FIG. 1 is a perspective view of an animated display constructed in accordance with first and second embodiments of the present invention.

Referring now to the drawings wherein the showings are for purposes of illustrating preferred embodiments of the present invention only, and not for purposes of limiting the same, FIG. 1 perspectively illustrates an animated display 10 constructed in accordance with both first and second embodiments of the present invention. As shown in FIG. 1, the animated display 10 has a seasonal motif (i.e., a Christmas theme). However, those of ordinary skill in the art will recognize that the present animated display 10 need not necessarily be constructed to have a seasonal theme, with the Christmas theme depicted in FIG. 1 being for exemplary purposes only.

Referring now to FIGS. 2–6, in the first embodiment of the present invention, the animated display 10 comprises a cylindrically configured, tubular outer sleeve 12 and a cylindrically configured, tubular inner sleeve 14. Attached to the upper end of the outer sleeve 12 is an enlarged, annular collar 16. The inner sleeve 14 is preferably fabricated from a translucent material, and includes decorative indicia thereon. The outer sleeve 12 is preferably fabricated from a transparent material itself having decorative indicia thereon. The collar 16 attached to the outer sleeve 12 is preferably fabricated from a translucent or opaque material, and also includes decorative indicia thereon. The inner sleeve 14 is concentrically positioned within the outer sleeve 12. The outer and inner sleeves 12, 14 are sized relative to each other such that a narrow, annular gap of uniform width is defined between the outer and inner sleeves 12, 14 when the inner sleeve 14 is advanced into the outer sleeve 12. The outer and inner sleeves 12, 14 are further rotatable relative to each other at differing speeds in a manner which will be described in more detail below.

In the animated display 10 of the first embodiment, the outer sleeve 12 is rotatably connected to a circularly configured support base 18. In this regard, formed on the bottom end of the outer sleeve 12 is a continuous flange portion 20 which extends radially outward relative to the remainder of the outer sleeve 12. The flange portion 20 is slidably receiveable into a complementary, continuous channel 22 formed in the inner surface of the annular peripheral wall of the support base 18. The receipt of the flange portion 20 into the channel 22 facilitates the rotatable connection of the outer sleeve 12 to the support base 18. Additionally, formed on the inner surface of the outer sleeve 12 in close proximity to the flange portion 20 is another flange portion 24 which extends radially inward relative to the remainder of the outer sleeve 12. Formed on the inner peripheral edge of the flange portion 24 are gear teeth 26. The use of the gear teeth 26 in relation to the rotation of the outer sleeve 12 relative to the support base 18 will be discussed in more detail below.

In the animated display 10 constructed in accordance with the first embodiment, the inner sleeve 14 itself defines an annular flange portion 28 which extends radially inward from the top end thereof. The inner peripheral edge of the flange portion 28 is formed to define gear teeth 30 for reasons which will be discussed in more detail below. Additionally, formed on the inner surface of the flange portion 28 are four cylindrically configured attachment bosses 32 which are equidistantly spaced at intervals of approximately ninety degrees. The use of the bosses 32 will also be discussed in more detail below. In addition to the flange portion 28, the inner sleeve 14 includes a flange portion 34 which extends radially inward from the bottom end thereof. The inner peripheral edge of the flange portion 34 is formed to define gear teeth 36, the use of which will also be discussed in more detail below.

It is contemplated that rather than comprising integral portions of the inner sleeve 14, the flange portion 28, bosses 32, and gear teeth 36 may be defined by a separate, annular display platform ring which is attached to a modified inner sleeve defining an annular top rim. In this regard, the display platform ring and modified inner sleeve, when attached to each other, collectively define a component structurally analogous to the inner sleeve 14.

In the animated display 10 of the first embodiment, the support base 18 includes a battery compartment 38 positioned thereon and extending upwardly therefrom. Mounted to and extending upwardly from the battery compartment 38 is a lamp assembly 40. The lamp assembly 40 is in electrical communication with the battery compartment 38 and includes a lamp fixture comprising a light bulb 42 and a reflector 44 which are mounted to a support post 46. The lamp assembly 40 further comprises a cylindrical, tubular shroud 48 which is attached to the support post 46. Extending axially from the top of the shroud 48 is a cylindrically configured, tubular post 50. The shroud 48 may be fabricated from a transparent or translucent material of any desired color.

Mounted to one side of the battery compartment 38 is a drive motor 52. The drive motor 52 is operatively coupled to a plurality of wheels 54 within the support base 18 via a gear train 56 including a series of mechanically coupled drive gears. It is contemplated that the animated display 10 of the first embodiment will include a total of three wheels 54, with two wheels 54 being disposed on a common side of the battery compartment 38 and the remaining wheel 54 being disposed on the opposite side thereof such that the wheels 54 are arranged in a generally triangular configuration. The drive motor 52 is also electrically connected to the battery compartment 38. The activation of the drive motor 52 is operative to facilitate the rotation of the wheels 54, and hence the linear or rotational movement of the animated display 10 along a generally planar surface. The lower end of the battery compartment 38 is normally covered by a compartment door 58. The detachment of the compartment door 58 from the support base 18 allows for the placement of batteries into the interior of the battery compartment 38. As seen in FIG. 1, the annular peripheral wall of the support base 18 may include decorative indicia attached to the outer surface thereof.

In the animated display 10 of the first embodiment, the outer sleeve 12 is rotatable relative to the support base 18. The inner sleeve 14 is also rotatable relative to the support base 18 in the opposite direction of rotation as the outer sleeve 12, and at a different rotational speed. However, as will be discussed in more detail below, the animated display 10 may be configured such that the outer and inner sleeves 12, 14 are rotatable relative to the support base 18 in the same direction. The rotation of the outer and inner sleeves 12, 14 relative to the support base 18 and each other is facilitated by an actuation assembly 60 of the animated display 10.

The actuation assembly 60 comprises an actuation motor 62 which is mounted to the support base 18 via a bracket 64. The actuation motor 62 is mechanically coupled to a gear train 66 which is mounted to a support plate 68. The support plate 68 is itself attached to the support base 18. The gear train 66 includes a first gear 70 which is intermeshed with a lower drive gear 72 mounted to a drive shaft 74 rotatably connected to the support plate 68. Also mounted to the drive shaft 74 is an upper drive gear 76. The upper drive gear 76 is mounted to the top portion of the drive shaft 74 and is disposed in spaced relation to the lower drive gear 72 which is of a diameter exceeding that of the upper drive gear 76. In the actuation assembly 60, the rotation of the motor shaft 78 protruding from the actuation motor 62 facilitates the rotation of the drive shaft 74 via the gear train 66, and hence the concurrent rotation of the lower and upper drive gears 72, 76.

In the actuation assembly 60, the lower drive gear 72 is intermeshed with a supplemental lower drive gear 73. Attached to the top surface of the supplemental lower drive gear 73 is a supplemental upper drive gear 75 which is coaxially aligned with the supplemental lower drive gear 73 and is of a decreased diameter relative thereto. Due to the intermesh between the lower drive gear 72 and the supplemental lower drive gear 73, the rotation of the drive shaft 74 and hence the lower drive gear 72 facilitates the concurrent rotation of the supplemental lower and upper drive gears 73, 75 in a direction opposite that of the lower and upper drive gears 72, 76.

The actuation assembly 60 further comprises a generally cross-shaped support strut 80 which is rotatably connected to the post 50 extending from the shroud 48 of the lamp assembly 40. The support strut 80 defines a circularly configured central hub 82 having four arms 84 extending radially therefrom at intervals of approximately ninety degrees. The central hub 82 defines a circularly configured opening 86 within the top thereof. Rotatably connected to the support strut 80 and extending axially through the opening 86 is a shaft 88. Rigidly mounted to the top portion of the shaft 88 is a gear 90. The bottom portion of the shaft 88 is advanced into the tubular post 50 extending from the top of the shroud 48 and rigidly affixed therein. As indicated above, the support strut 80 is rotatably connected to the shaft 88. The gear 90 is intermeshed with three identically configured planetary gears 92 which are rotatably mounted to the central hub 82 and are spaced about the shaft 88 (and hence the gear 90) at intervals of approximately 120 degrees.

In the animated display 10 of the first embodiment, the inner sleeve 14 is attached to the actuation assembly 60, and more particularly to the support strut 80 thereof. Such attachment is facilitated by the advancement of fasteners through the bosses 32 of the inner sleeve 14 into complementary bosses 94 formed on the upper surfaces of respective ones of the arms 84 adjacent the distal ends thereof. Thus, the inner sleeve 14 rotates concurrently with the support strut 80, i.e., the rotation of the inner sleeve 14 facilitates the simultaneous rotation of the support strut 80.

Mechanically coupled to the planetary gears 92 is a plate holder 96 which defines a circularly configured central opening having gear teeth 98 formed about the peripheral inner surface thereof. The plate holder 96 is advanceable over the planetary gears 92 such that the planetary gears 92 reside within the opening of the plate holder 96 and are intermeshed to the gear teeth 98. The plate holder 96 further defines a shaft aperture which is radially offset relative to the shaft 88 when the plate holder 96 is mechanically coupled to the planetary gears 92. Rotatably received into the shaft aperture of the plate holder 96 is the lower portion of a plate shaft 100. The top end of the plate shaft 100 is attached to a circularly configured display plate 102. The display plate 102 is formed to include gear teeth 104 about the peripheral edge thereof. Additionally, disposed within the display plate 102 adjacent the peripheral edge thereof is a pair of circularly configured magnets 106 which are separated from each other by an interval of approximately 180 degrees.

The display plate 102 comprises the uppermost component of the actuation assembly 60. When the inner sleeve 14 is attached to the support strut 80 in the above-described manner, the gear teeth 104 of the display plate 102 are intermeshed with the gear teeth 30 formed on the inner peripheral edge of the flange portion 28 of the inner sleeve 14. The rotation of the inner sleeve 14 facilitates the rotation of the support strut 80 and hence the planetary gears 92 and plate holder 96 relative to the stationary gear 90. In view of the intermesh between the gear 90 and the planetary gears 92 and between the planetary gears 92 and the gear teeth 98 of the plate holder 96, the rotation of the support strut 80 facilitates the concurrent rotation of the plate holder 96. Due to the shaft aperture of the plate holder 96 being radially offset from the shaft 88, the rotation of the plate holder 96 results in the concurrent rotation of the plate shaft 100 and hence the display plate 102 about the axis of the shaft 88. Further, due to the intermesh between the gear teeth 104 of the display plate 102 and the gear teeth 30 of the inner sleeve 14, the movement of the display plate 102 about the axis of the shaft 88 facilitates the concurrent rotation of the display plate 102 about the axis of the plate shaft 100.

Figure 2:
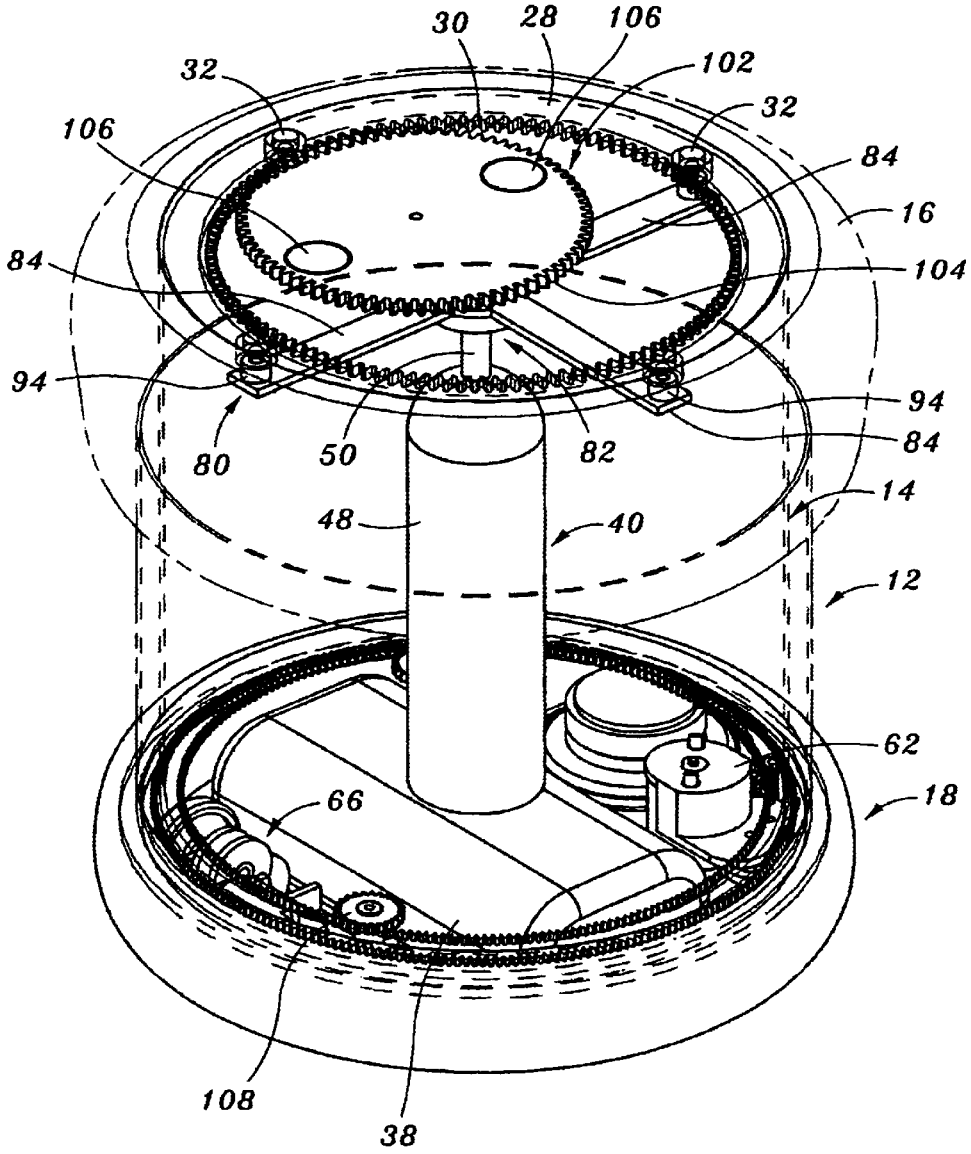
FIG. 2 is a top perspective view of the actuation assembly of the animated display of the first embodiment.
Figure 3:
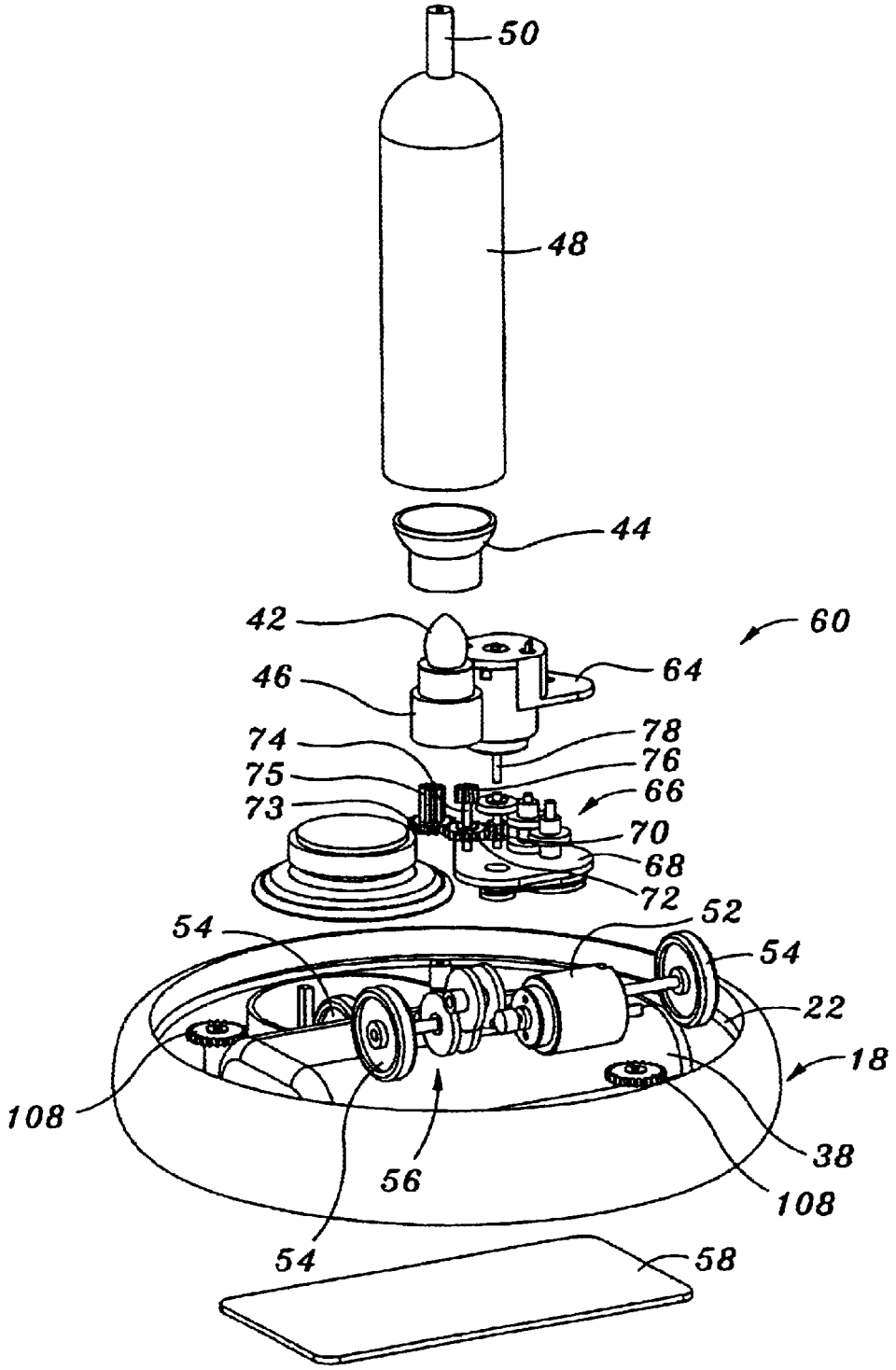
FIG. 3 is an exploded view of the lower portion of the actuation assembly of the animated display of the first embodiment.
Figure 4:
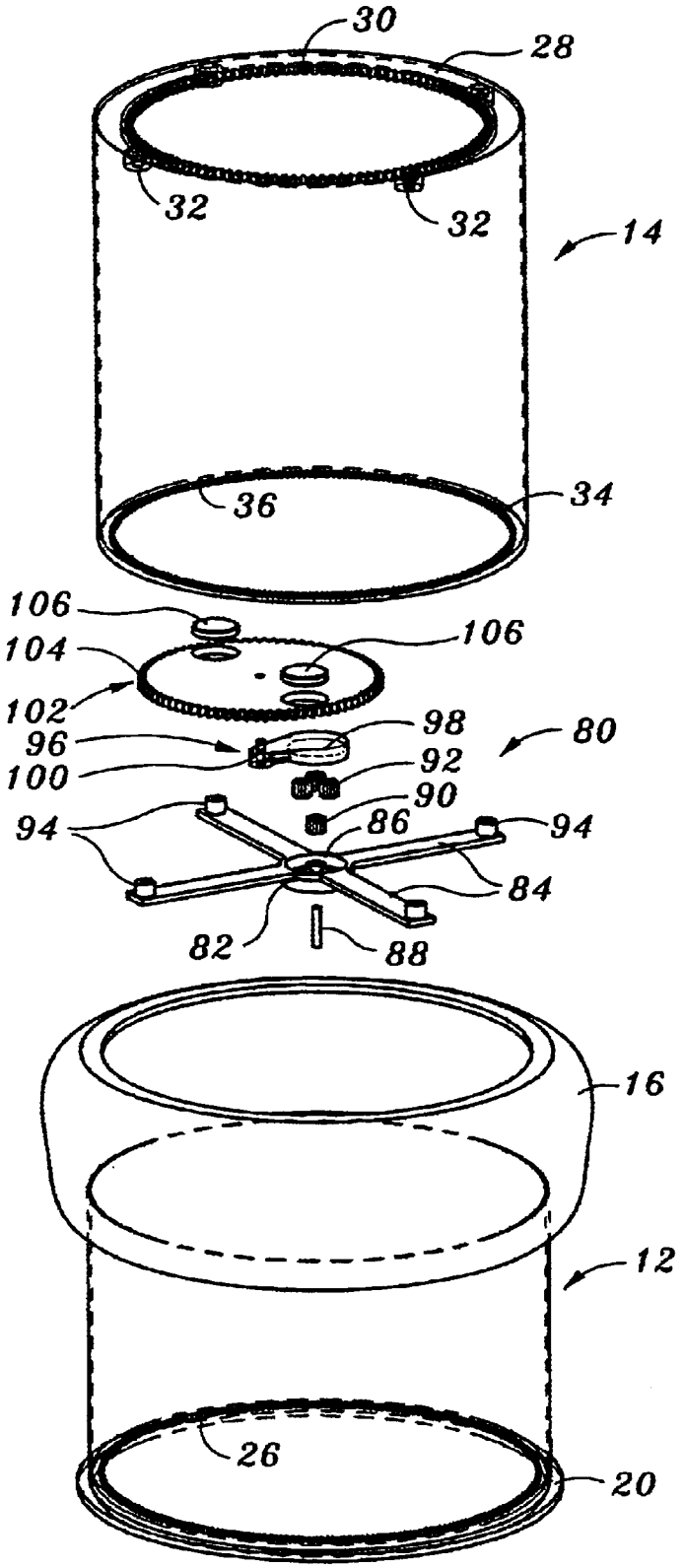
FIG. 4 is an exploded view of the inner and outer sleeves and the upper portion of the actuation assembly of the animated display of the first embodiment.
Figure 5:
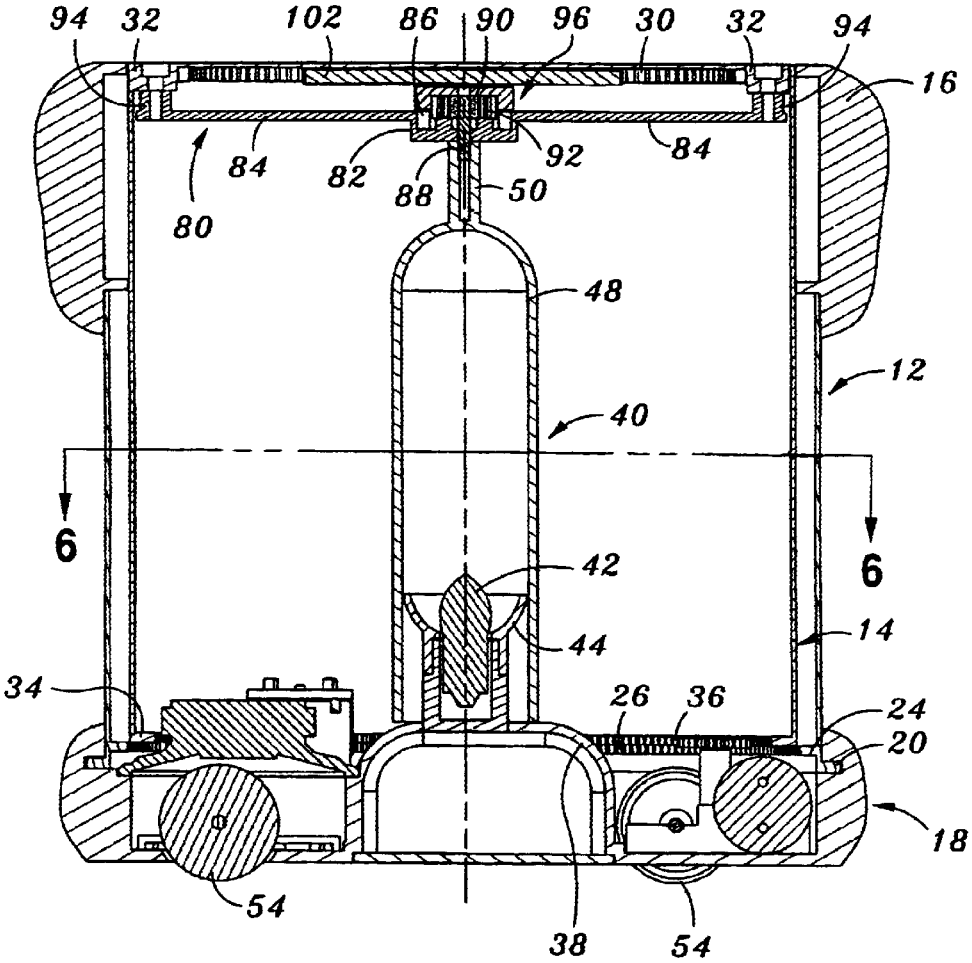
FIG. 5 is a cross-sectional view of the animated display of the first embodiment.
Figure 6:
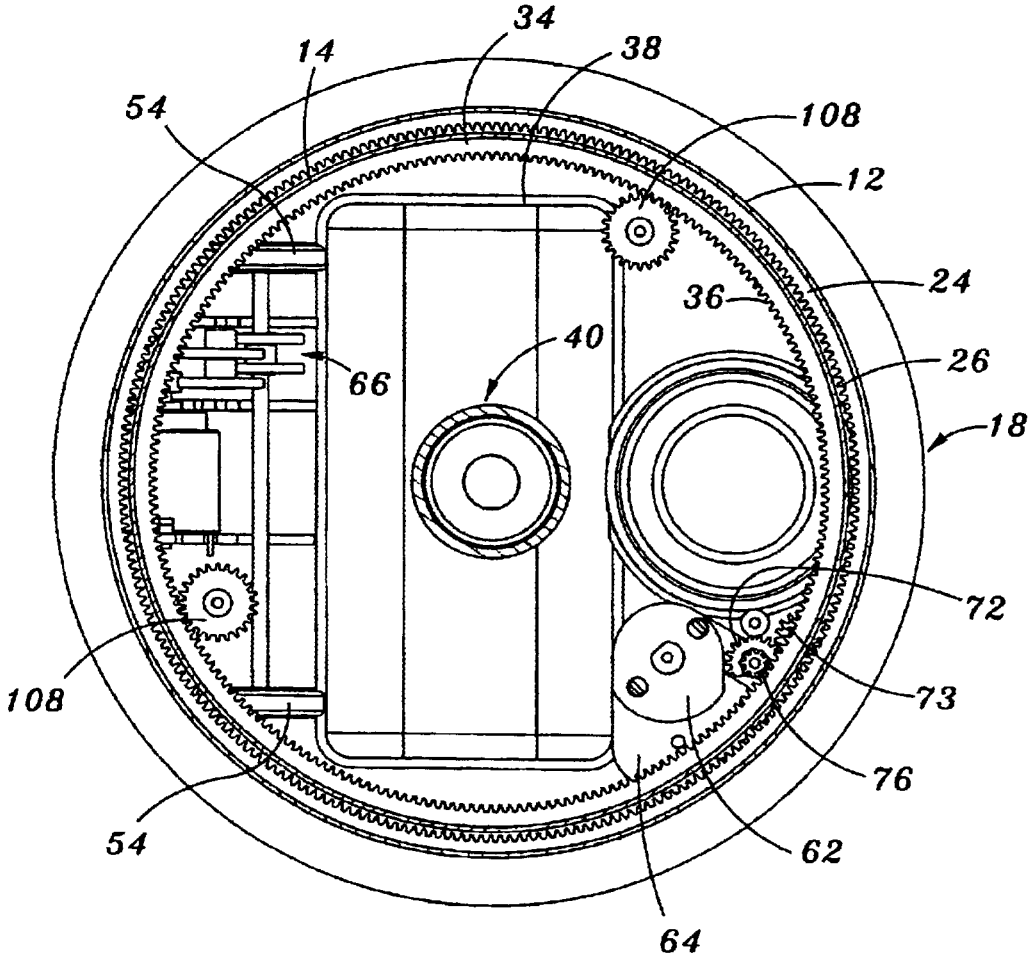
FIG. 6 is a cross-sectional view taken along line 6—6 of FIG. 5.
Figure 7:
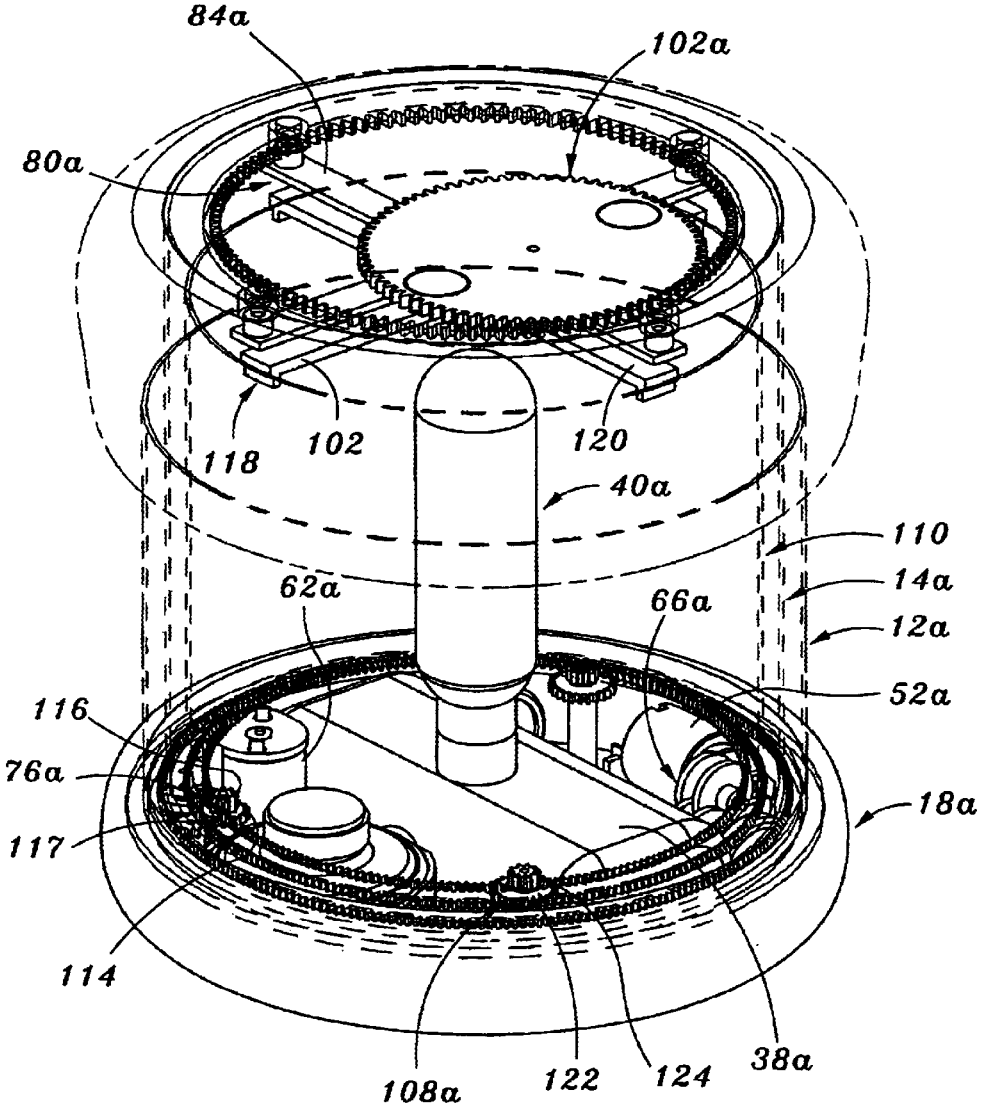
FIG. 7 is a top perspective view of the actuation assembly of the animated display of the second embodiment.
Figure 8:
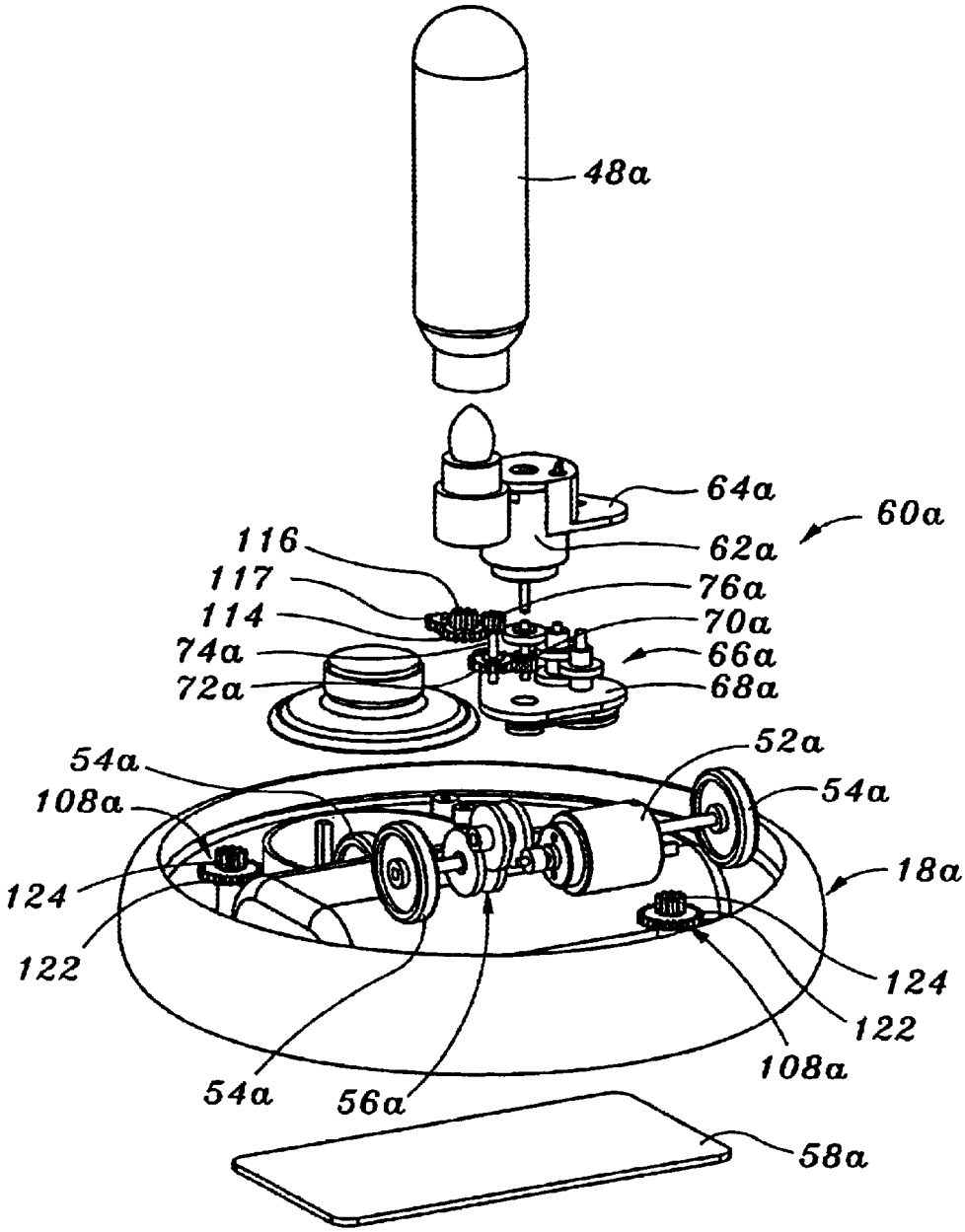
FIG. 8 is an exploded view of the lower portion of the actuation assembly of the animated display of the second embodiment.
Figure 9:
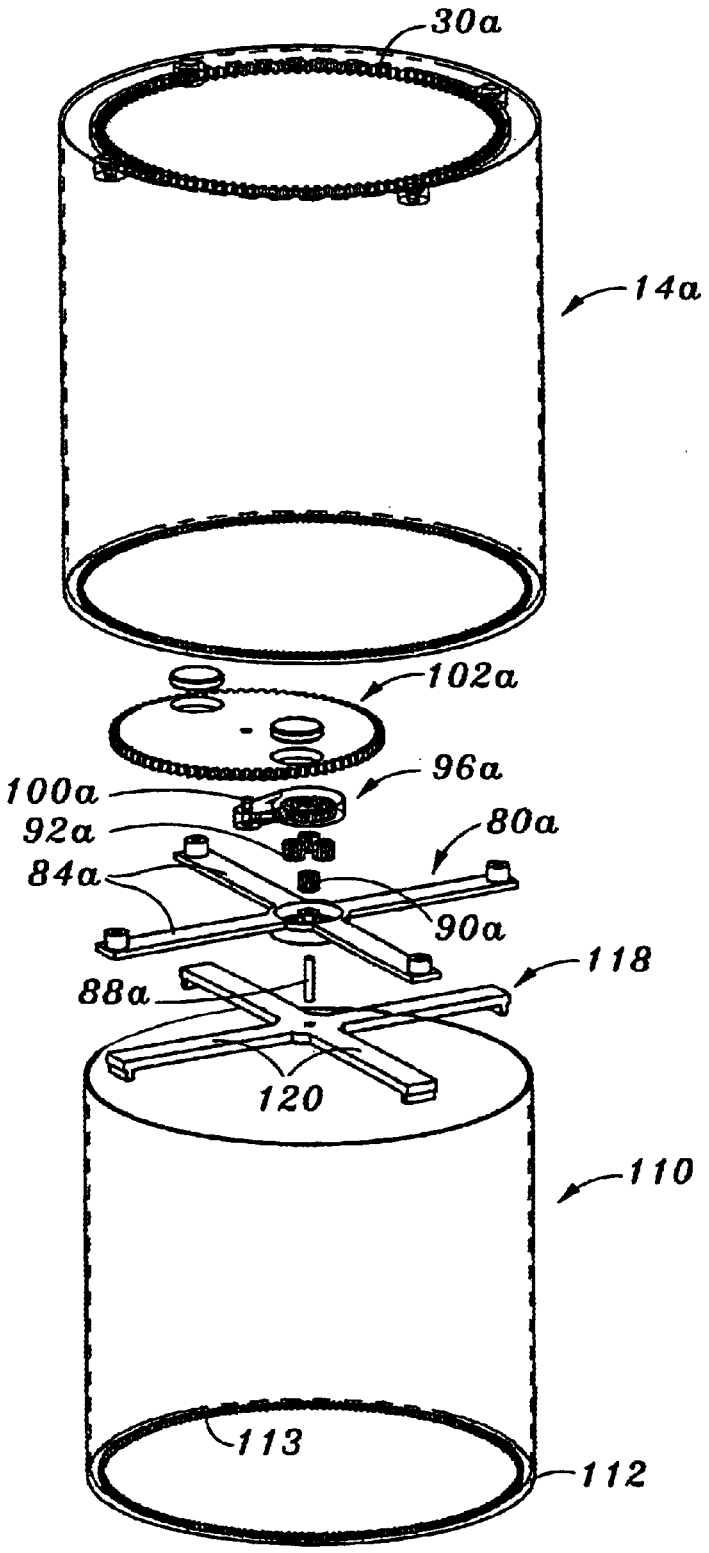
FIG. 9 is an exploded view of the middle and inner sleeves and the upper portion of the actuation assembly of the animated display of the second embodiment.

Referring now to FIGS. 2, 5 and 6, when the outer sleeve 12 is rotatably connected to the support base 18 in the above-described manner, the supplemental upper drive gear 75 of the actuation assembly 60 is intermeshed with the gear teeth 26 formed on the inner peripheral edge of the flange portion 24 of the outer sleeve 12. The inner sleeve 14 is supported within the outer sleeve 12 by the rotatable connection of the support strut 80 to the shaft 88 in the above-described manner. When the support strut 80, and hence the inner sleeve 14 are rotatably connected to the shaft 88 (which is rigidly affixed to the post 50), the upper drive gear 76 of the actuation assembly 60 is intermeshed with the gear teeth 36 formed on the inner peripheral edge of the flange portion 34 of the inner sleeve 14. As best seen in FIG. 5, due to the inner sleeve 14 being concentrically positioned within the outer sleeve 12, the gear teeth 36 of the flange portion 34 are disposed radially inward beyond the gear teeth 26 of the flange portion 24.

In operation, the activation of the actuation motor 62 facilitates the rotation of the drive shaft 74 via the gear train 66, and hence the concurrent rotation of the lower and upper drive gears 72, 76. The rotation of the lower and upper drive gears 72, 76 facilitates the concurrent rotation of the supplemental lower and upper drive gears 73, 75 in a direction opposite that of the lower and upper drive gears 72, 76. As indicated above, the outer sleeve 12 (which is rotatably connected to the support base 18) is rotated by the intermesh of the supplemental upper drive gear 75 to the gear teeth 26, with the inner sleeve 14 being rotated by the intermesh of the upper drive gear 76 to the gear teeth 36. Thus, the outer and inner sleeves 12, 14 are concurrently rotated in opposite directions. In addition to being rotated in opposite directions, the outer and inner sleeves 12, 14 also rotate at differing speeds attributable to the differing diameters of the supplemental upper drive gear 75 and upper drive gear 76 coupled with the differing diameters of the inner peripheral edges of the flange portions 24, 34. The rotation of the inner sleeve 14 and hence the support strut 80 facilitates the various rotational movements of the display plate 102 as described above.

It is contemplated that in the completed animated display 10 of the first embodiment, decorative indicia may be rigidly and/or movably attached to the top of the inner sleeve 14. The movable attachment of the decorative indicia to the top of the inner sleeve 14 may be accomplished by embedding certain magnetized materials such as magnetized metal plates into the bottom sides or surfaces of the decorative indicia. Such decorative indicia may include, for example, one or more ice skating figurines which are caused to move in a particular pattern attributable to the location of the magnets 106 within the rotating display plate 102, and the rotation of the display plate 102 about the axis of the shaft 88. To maintain the stability of the inner sleeve 14 during the rotation thereof, an identically configured pair of guiding gears 108 (as best seen in FIG. 6) are preferably rotatably connected to the support base 18 and intermeshed with the gear teeth 36 of the flange portion 34.

The animated display 10 of the first embodiment further includes control circuitry which controls and coordinates the various movements thereof. In this regard, the control circuitry is in electrical communication with the drive motor 52, the lamp assembly 40, the actuation motor 62, and an optional sound/music emitting element which may be included in the animated display 10. The control circuitry may be programmed to coordinate the movement of the animated display 10 along a planar surface, the rotation of the outer and inner sleeves 12, 14, the activation of the lamp assembly 40, and the generation of sound/music from a sound/music producing element (if included) in any desired manner. It is contemplated that the control circuitry, which will include one or more integrated circuit chips, may be disposed in virtually any location within the interior of the animated display 10.

It is further contemplated that the animated display 10 of the first embodiment may be provided with photo and/or sound sensors which are used to facilitate the activation of the control circuitry. In this regard, the operation of the animated display 10 may be commenced by motion and/or sound. Since the animated display 10 is capable of traveling along a generally planar surface, it is also contemplated that multiple photo sensors may be included in the annular peripheral wall of the support base 18. Such sensors would also be in electrical communication with the control circuitry and used to sense, for example, an edge of a table or some other obstruction. In this regard, the sensors would be used to prevent the animated display 10 from traveling or moving off the edge of a table or running into some object positioned thereon. Still further, it is contemplated that the animated display 10 may be outfitted with an infrared transceiver which is also electrically connected to the control circuitry and used to provide interactive communication with, for example, another animated display 10 or some other interactive device.

In the animated display 10 of the first embodiment, the outer and inner sleeves 12, 14 are each described as having cylindrical, tubular configurations. Those of ordinary skill in the art will recognize that the outer and inner sleeves 12, 14 may be fabricated in any combination of different shapes or forms. Since the inner sleeve 14 is rotatable within the outer sleeve 12, the sole requirement is that there be sufficient clearance between the outer and inner sleeves 12, 14 to allow for such relative rotation irrespective of the shapes thereof. Thus, by way of example, the outer sleeve 12 could have a cylindrical configuration, with the inner sleeve 14 having a square or triangular tubular configuration, so long as sufficient clearance is defined between the outer and inner sleeves 12, 14 to allow for the rotation of the inner sleeve 14 within the outer sleeve 12. It is further contemplated that the outer and inner sleeves 12, 14 will be fabricated from a material such as plastic or glass which can be made transparent or translucent. Other suitable materials would be paper and fabrics or combinations of various materials. Irrespective of their shape, one or both of the outer and inner sleeves 12, 14 may be fabricated in a manner wherein the decorative indicia comprises three-dimensional relief created by vacuum forming or some similar process. In this regard, the decorative indicia need not necessarily be confined to two-dimensional artwork applied to a smooth, continuous surface. If such three-dimensional decorative indicia is implemented, there must be sufficient clearance between the outer and inner sleeves 12, 14 to accommodate the same.

Though not shown, it is further contemplated that the actuation assembly 60 may alternatively be configured such that an additional gear is intermeshed between the supplemental upper drive gear 75 and the gear teeth 26 of the outer sleeve 12, or between the upper drive gear 76 and the gear teeth 36 of the inner sleeve 14. This additional gear could be used to facilitate the rotation of the outer and inner sleeves 12, 14 in the same direction rather than in the opposite directions. It is also contemplated that any one of the outer and inner sleeves 12, 14 may be constructed from top and bottom annular frames which include a flexible or rigid material extending therebetween. Additionally, though an exemplary embodiment of the actuation assembly 60 is described herein, those of ordinary skill in the art will recognize that other actuation assemblies of like functionality may be included in the animated display 10.

Referring now to FIGS. 7–11, there is depicted the second embodiment of the animated display 10 of the present invention. The animated display 10 of the second embodiment is structurally similar to the animated display 10 of the first embodiment. In this regard, the animated display 10 of the second embodiment includes an outer sleeve 12*a* which is identically configured to the outer sleeve 12 of the first embodiment and is rotatably connected to a support base 18*a* of the second embodiment (which is identical to the support base 18) in the same manner previously described in relation to the rotatable connection of the outer sleeve 12 to the support base 18 of the first embodiment. The animated display 10 of the second embodiment also includes a middle sleeve 14*a* which is concentrically positioned within the outer sleeve 12*a* and is identically configured to the inner sleeve 14 of the animated display 10 of the first embodiment. In addition to the outer and middle sleeves 12*a*, 14*a*, the animated display 10 of the second embodiment includes a cylindrically configured, tubular inner sleeve 110 which is concentrically positioned within the middle sleeve 14*a*, and is sized relative to the middle sleeve 14*a* such that a narrow, annular gap of uniform width is defined therebetween. Thus, in contrast to the animated display 10 of the first embodiment which included only the outer and inner sleeves 12, 14, the animated display 10 of the second embodiment includes the outer and inner sleeves 12*a*, 110 having the middle sleeve 14*a* positioned therebetween. In the animated display 10 of the second embodiment, the outer and middle sleeves 12*a*, 14*a* are each preferably fabricated from a transparent material and include decorative indicia thereon, with the inner sleeve 110 preferably being fabricated from a translucent material and itself including decorative indicia thereon.

Formed on the bottom end of the inner sleeve 110 of the second embodiment is a continuous flange portion 112 which extends radially inward relative to the remainder of the inner sleeve 110. Formed on the inner peripheral edge of the flange portion 112 are gear teeth 113. The gear teeth 113 are used to facilitate the rotation of the inner sleeve 110 in a manner which will be discussed in more detail below. Included within the support base 18*a* of the animated display 10 of the second embodiment is a battery compartment 38*a*, drive motor 52*a*, wheels 54*a*, gear train 56*a* and compartment door 58*a* which are structurally and functionally identical to the battery compartment 38, drive motor 52, wheels 54, gear train 56, and compartment door 58, respectively, of the animated display 10 of the first embodiment. Additionally, the animated display 10 of the second embodiment includes a lamp assembly 40*a* which is identical to the above-described lamp assembly 40 with the exception that the shroud 48*a* of the lamp assembly 40*a* does not include the above-described post 50 extending axially from the top thereof.

Also included in the animated display 10 of the second embodiment is an actuation assembly 60*a* which is substantially similar to the actuation assembly 60 of the first embodiment, and includes an actuation motor 62*a*, a bracket 64*a*, a gear train 66*a*, a support plate 68*a*, a first gear 70*a*, a lower drive gear 72*a*, a drive shaft 74*a*, and an upper drive gear 76*a* which are identically configured to the above-described actuation motor 62, bracket 64, gear train 66, support plate 68, first gear 70, lower drive gear 72, drive shaft 74 and upper drive gear 76, respectively, and are interfaced to each other in the same manner previously described in relation to the first embodiment regarding these particular components. In addition to these common components, the actuation assembly 60*a* of the second embodiment includes a supplemental lower drive gear 114 which is intermeshed with the upper drive gear 76*a* and includes a supplemental upper drive gear 116 of reduced diameter extending axially upwardly therefrom. Intermeshed to the supplemental lower drive gear 114 is a drive gear 117. The use of the supplemental lower and upper drive gears 114, 116 and drive gear 117 will be discussed in more detail below.

Figure 10:
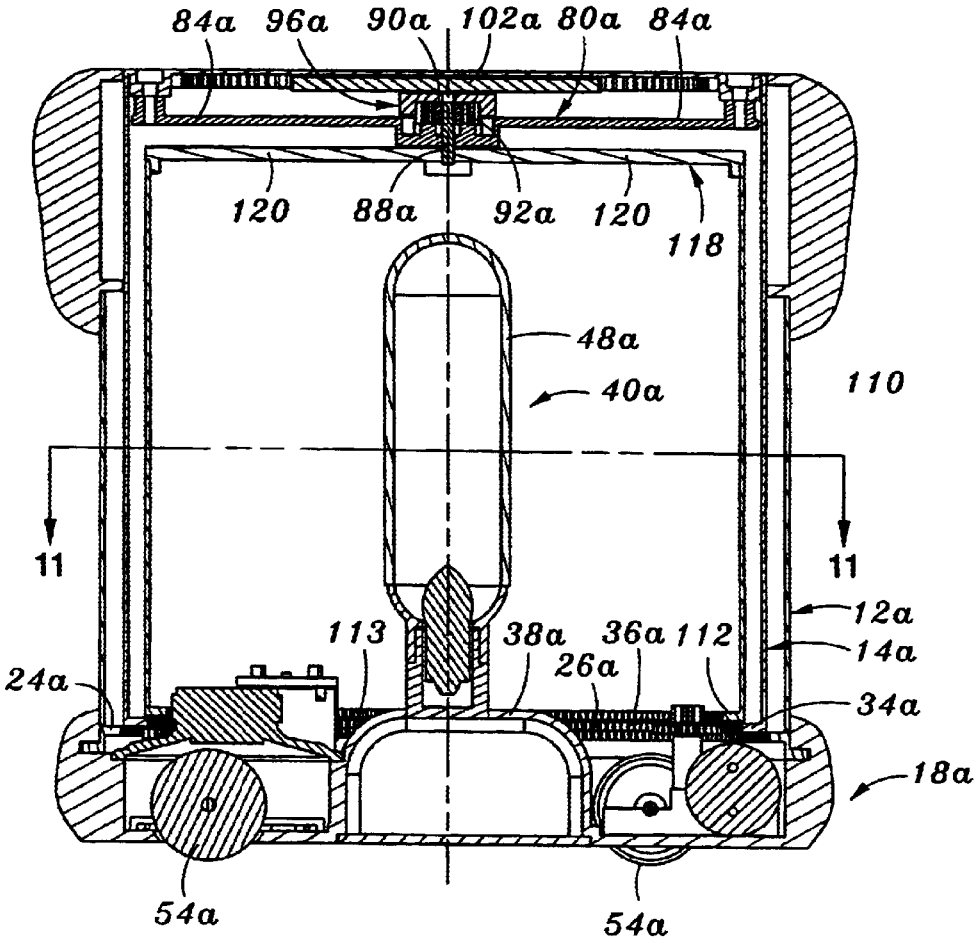
FIG. 10 is a cross-sectional view of the animated display of the second embodiment.
Figure 11:
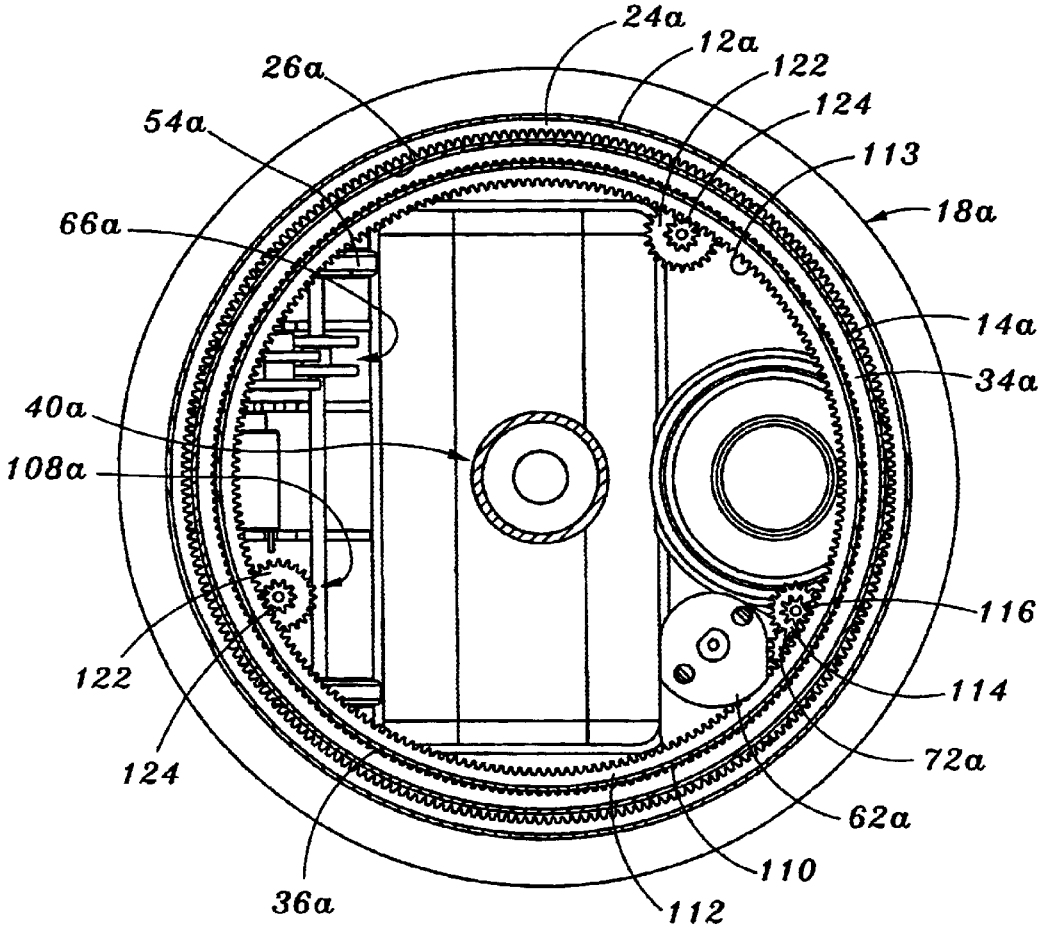
FIG. 11 is a cross-sectional view taken along line 11—11 of FIG. 10.

The actuation assembly 60*a* of the animated display 10 of the second embodiment further includes a support strut 80*a* which is identically configured to the above-described support strut 80 and is attached to the middle sleeve 14*a* in the same manner previously described in relation to the attachment of the inner sleeve 14 to the support strut 80. The actuation assembly 60*a* also includes a shaft 88*a*, gear 90*a*, planetary gears 92*a*, plate holder 96*a*, plate shaft 100*a*, and display plate 102*a* which are identical, structurally and functionally, to the above-described shaft 88, gear 90, planetary gears 92, plate holder 96, plate shaft 100, and display plate 102, respectively, and are interfaced to each other and to the gear teeth 30*a* of the middle sleeve 14*a* in the same manner previously described in relation to the first embodiment. However, in the animated display 10 of the second embodiment, due to the absence of the above-described post 50 extending from the shroud 48*a*, the lower portion of the shaft 88*a* is alternatively rigidly attached to a generally cross-shaped secondary support strut 118. The secondary support strut 118 includes four arms 120 which are disposed at intervals of approximately ninety degrees and each have lengths slightly less than those of the arms 84*a* of the support strut 80*a*. The rotatable connection of the shaft 88*a* to the support strut 80*a* allows for the rotation of the secondary support strut 118 relative to the support strut 80*a*. As best seen in FIG. 10, the top end of the inner sleeve 110 is attached to the arms 120 of the secondary support strut 118. Thus, in contrast to the animated display 10 of the first embodiment, the animated display 10 of the second embodiment includes the secondary support strut 118 in addition to the support strut 80*a*.

In the animated display 10 of the second embodiment, when the outer sleeve 12*a* is rotatably connected to the support base 18*a*, the drive gear 117 of the actuation assembly 60*a* is intermeshed with the gear teeth 26*a* formed on the inner peripheral edge of the flange portion 24*a* of the outer sleeve 12*a*. The upper drive gear 76*a* of the actuation assembly 60*a* is itself intermeshed with the gear teeth 36*a* formed on the inner peripheral edge of the flange portion 34*a* of the middle sleeve 14*a*. Due to the middle sleeve 14*a* being concentrically positioned within the outer sleeve 12*a*, the flange portion 34*a* extends radially inward beyond the inner peripheral edge (and hence the gear teeth 26*a*) of the flange portion 24*a*. The supplemental upper drive gear 116 of the actuation assembly 60*a* is itself intermeshed with the gear teeth 113 formed on the inner peripheral edge of the flange portion 112 of the inner sleeve 110. Due to the inner sleeve 110 being concentrically positioned within the middle sleeve 14*a*, the flange portion 112 extends radially inward beyond the inner peripheral edge (and hence the gear teeth 36*a*) of the flange portion 34*a*.

In operation, the activation of the actuation motor 62*a* facilitates the rotation of the drive shaft 74*a* via the gear train 66*a*, and hence the concurrent rotation of the lower and upper drive gears 72*a*, 76*a* in the same direction. Due to the intermesh between the upper drive gear 76*a* and the supplemental lower drive gear 114, the rotation of the lower and upper drive gears 72*a*, 76*a* facilitates the concurrent rotation of the supplemental lower and upper drive gears 114, 116 in a direction opposite that of the lower and upper drive gears 72*a*, 76*a*. Similarly, the intermesh of the drive gear 117 to the supplemental lower drive gear 114 facilitates the concurrent rotation of the drive gear 117 in a direction opposite that of the supplemental lower and upper drive gears 114, 116, i.e., in the same direction as that of the lower and upper drive gears 72*a*, 76*a*. The outer sleeve 12*a* (which is rotatably connected to the support base 18*a*) is rotated by the intermesh of the drive gear 117 to the gear teeth 26*a*, with the middle sleeve 14*a* being rotated by the intermesh of the upper drive gear 76*a* to the gear teeth 36*a* and the inner sleeve 110 being rotated by the intermesh of the supplemental upper drive gear 116 to the gear teeth 113. It will be recognized that due to the configuration of the actuation assembly 60*a*, the outer and middle sleeves 12*a*, 14*a*, though being rotated in the same direction, will rotate at differing speeds attributable to the differing diameters of the drive gear 117 and upper drive gear 76*a* coupled with the differing diameters of the inner peripheral edges of the flange portions 24*a*, 34*a*. The inner sleeve 110 will be rotated in a direction opposite to that of the outer and middle sleeves 12*a*, 14*a* at yet a different rotational speed attributable to the diameter of the supplemental upper drive gear 116 and the diameter of the inner peripheral edge of the flange portion 112 of the inner sleeve 110. To maintain the stability of the middle and inner sleeves 14*a*, 110 during the rotation thereof, an identically configured pair of guiding gears 108*a* are preferably rotatably connected to the support base 18*a*. Each of the guiding gears 108*a* includes a lower gear portion 122 which is intermeshed with the gear teeth 36*a* of the flange portion 34*a*, and a reduced diameter upper gear portion 124 which is intermeshed with the gear teeth 113 of the flange portion 112. The lower and upper gear portions 122, 124 of each of the guiding gears 108*a* are not rigidly attached to each other, but rather are rotatable independently of each other. Such independent rotation is made necessary by the differing rotational speeds of the middle and inner sleeves 14*a*, 110 upon the activation of the actuation assembly 60*a*.

Those of ordinary skill in the art will recognize that the animated display 10 of the second embodiment is also provided with the above-described control circuitry, and may be provided with the above-described photo and/or sound sensors. It is also contemplated that the various structural and functional alternatives described above in relation to the animated display 10 of the first embodiment may be incorporated into the animated display 10 of the second embodiment. For example, additional gears may be intermeshed between any one of the upper drive gear 76*a*, supplemental upper drive gear 116 and drive gear 117 and the corresponding gear teeth 36*a*, 113, 26*a* to facilitate the rotation of the middle, inner and outer sleeves 14*a*, 110, 12*a* in the same or opposite directions in any combination.

Figure 12:
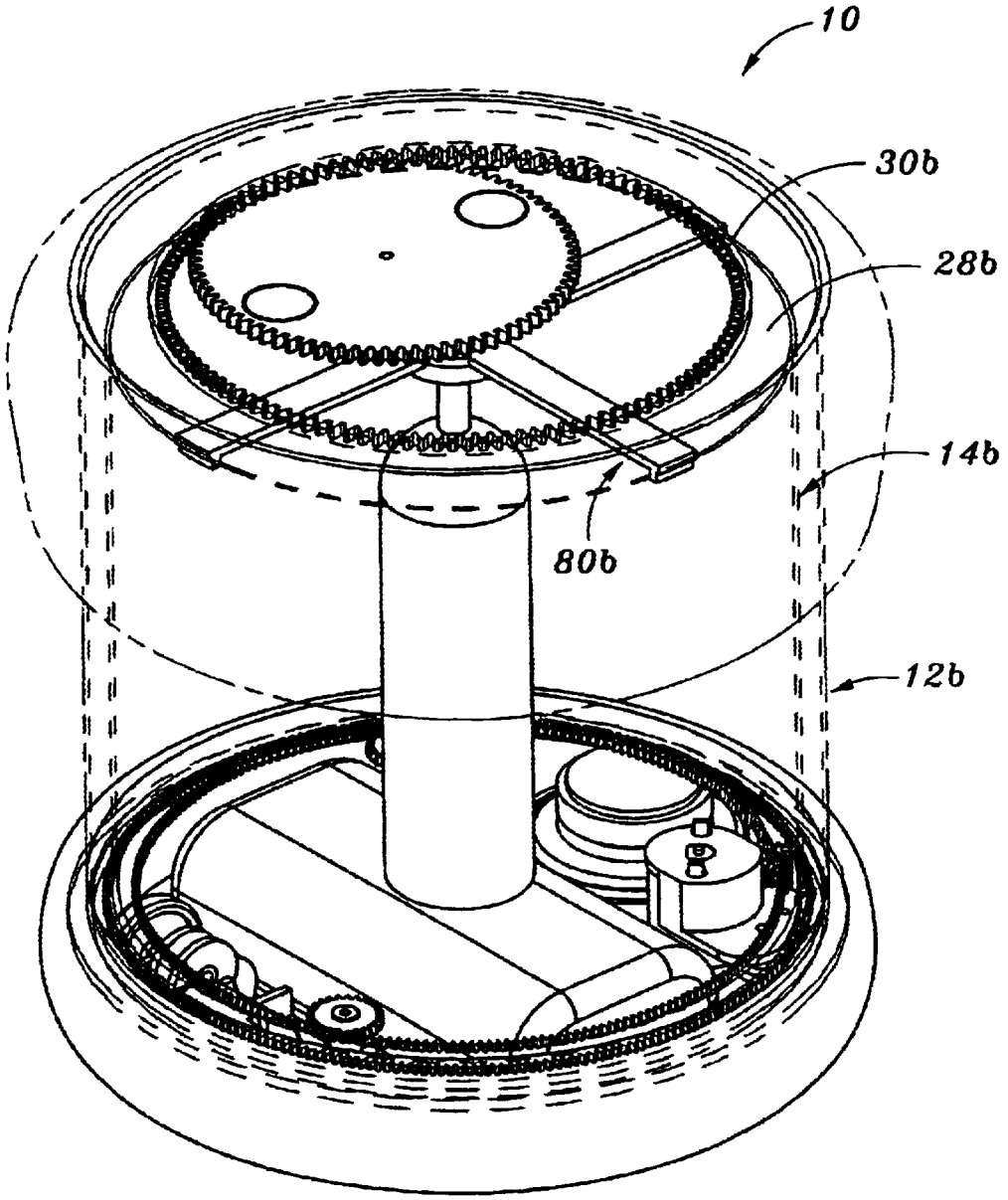
FIG. 12 is a top perspective view of an alternative actuation assembly which may be employed in the animated display of the first embodiment.

Referring now to FIG. 12, it is contemplated that the animated display 10 of the first embodiment may be modified to include an outer sleeve 12*b* which is formed to include a flange portion 28*b* and gear teeth 30*b* analogous to the flange portion 28 and gear teeth 30 formed as part of the inner sleeve 14 in the first embodiment. Thus, in this modified version of the first embodiment, the inner sleeve 14*b* will define only an annular top rim, and will not include the above-described flange portion 28 and gear teeth 30. In the modified version of the first embodiment, a support strut 80*b* is included which is similar to the above-described support strut 80, and is rigidly attached to the inner sleeve 14*b*. Thus, the rotation of the support strut 80*b* is facilitated by the rotation of the inner sleeve 14*b*. The overall functionality of the modified version of the animated display 10 as shown in FIG. 12 is identical to the animated display 10 of the first embodiment described above in all other respects. It will be recognized that the flange portion 28*b* and gear teeth 30*b* of the outer sleeve 12*b* may be defined by a separate display platform ring attached to the top rim of the outer sleeve 12*b* as discussed above in relation to the first embodiment.

Moreover, those of ordinary skill in the art will recognize that an additional potential modification to the animated display 10 of the first embodiment would be to remove the outer sleeve 12 therefrom in its entirety. In this regard, the collar 16 could be attached directly to the inner sleeve 14. The actuation assembly 60 would also be slightly modified to eliminate those components used to facilitate the rotation of the outer sleeve 12. In the further modified version of the animated display 10 including only the inner sleeve 14 (which could be rotatably connected to the support base 18), the activation of the actuation assembly 60 would facilitate the rotation of the inner sleeve 14, and the various movements of the display plate 102 as described above.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. An animated device comprising:

an outer sleeve;

an inner sleeve positioned within the outer sleeve and defining an inner sleeve axis; and an actuation assembly including a display plate which defines a plate axis extending in generally parallel relation to the inner sleeve axis, the actuation assembly being cooperatively engaged to the inner sleeve and configured to facilitate the rotation of the inner sleeve relative to the outer sleeve about the inner sleeve axis concurrently with the rotation of the display plate about the inner sleeve and display plate axes.

2. The animated device of claim 1 wherein:

the animated device further comprises a support base;

the outer sleeve is rotatably connected to the support base; and the actuation assembly is configured to facilitate the rotation of the outer sleeve relative to the support base.

3. The animated device of claim 2 wherein the actuation assembly is configured to facilitate the simultaneous rotation of the inner and outer sleeves in opposite directions at different rotational speeds.

4. The animated device of claim 2 wherein:

the outer sleeve defines an outer sleeve axis which is coaxially aligned with the inner sleeve axis; and the actuation assembly is configured to facilitate the rotation of the outer sleeve relative to the support base about the outer sleeve axis.

5. The animated device of claim 1 wherein:

the outer sleeve is fabricated from a transparent material having decorative indicia thereon; and the inner sleeve is fabricated from a translucent material having decorative indicia thereon.

6. An animated device comprising:

an outer sleeve;

a middle sleeve positioned within the outer sleeve;

an inner sleeve positioned within the middle sleeve; and an actuation assembly including a display plate, the actuation assembly being cooperatively engaged to the inner and middle sleeves and configured to facilitate the rotation of the middle sleeve, the inner sleeve, the outer sleeve and the display plate relative to each other.

7. The animated device of claim 6 wherein:

the animated device further comprises a support base;

the outer sleeve is rotatably connected to the support base; and the actuation assembly is configured to facilitate the rotation of the outer sleeve relative to the support base.

8. The animated device of claim 7 wherein the actuation assembly is configured to facilitate the concurrent rotation of the middle and outer sleeves in the same direction at different rotational speeds, and the simultaneous rotation of the inner sleeve in a direction opposite the middle and outer sleeves.

9. The animated device of claim 6 wherein:

the outer sleeve is fabricated from a transparent material having decorative indicia thereon;

the middle sleeve is fabricated from a transparent material having decorative indicia thereon; and the inner sleeve is fabricated from a translucent material having decorative indicia thereon.

10. The animated device of claim 6 wherein:

the middle sleeve defines an middle sleeve axis;

the display plate defines a plate axis which extends in generally parallel relation to the middle sleeve axis; and the actuation assembly is configured to facilitate the rotation of the display plate about the middle sleeve and display plate axes concurrently with the rotation of the middle and inner sleeves relative to the outer sleeve.

11. The animated device of claim 10 wherein:

the outer sleeve defines an outer sleeve axis;

the inner sleeve defines an inner sleeve axis; and the outer and inner sleeve axes are coaxially aligned with the middle sleeve axis.

12. An animated device comprising:

a sleeve defining a sleeve axis; and an actuation assembly including a display plate which defines a plate axis which extends in generally parallel relation to the sleeve axis;

the actuation assembly being cooperatively engaged to the sleeve and configured to facilitate the rotation of the sleeve about the sleeve axis concurrently with the rotation of the display plate about the sleeve and display plate axes.

13. The animated device of claim 12 wherein:

the animated device further comprises a support base; and the sleeve is rotatably connected to the support base, with the actuation assembly being operative to facilitate the rotation of the sleeve relative to the support base.

14. An animated device comprising:

an outer sleeve defining an outer sleeve axis;

an inner sleeve positioned within the outer sleeve; and an actuation assembly including a display plate which defines a plate axis extending in generally parallel relation to the outer sleeve axis, the actuation assembly being cooperatively engaged to the outer and inner sleeves and configured to facilitate the rotation of the inner sleeve relative to the outer sleeve concurrently with the rotation of the display plate about the outer sleeve and display plate axes.

15. The animated device of claim 14 wherein:

the animated device further comprises a support base;

the outer sleeve is rotatably connected to the support base; and the actuation assembly is configured to facilitate the rotation of the outer sleeve relative to the support base about the outer sleeve axis.

16. The animated device of claim 15 wherein the actuation assembly is configured to facilitate the simultaneous rotation of the inner and outer sleeves in opposite directions at different rotational speeds.

17. The animated device of claim 15 wherein:

the inner sleeve defines an inner sleeve axis which is coaxially aligned with the outer sleeve axis; and the actuation assembly is configured to facilitate the rotation of the inner sleeve about the inner sleeve axis.

* * * * *